United States Patent [19]

Post

[11] Patent Number: 4,920,779

[45] Date of Patent: May 1, 1990

[54] BENDING APPARATUS

[75] Inventor: Friedheim Post, Bad Säckingen-Wallbach, Fed. Rep. of Germany

[73] Assignee: Alpha Maschinenbau AG, Zurich, Switzerland

[21] Appl. No.: 385,552

[22] Filed: Jul. 26, 1989

[30] Foreign Application Priority Data

Jul. 26, 1988 [DE] Fed. Rep. of Germany ..... 3825393

[51] Int. Cl.[5] ..... B21D 7/02; B21F 1/00

[52] U.S. Cl. ..... 72/7; 72/294; 72/307; 72/386; 72/215

[58] Field of Search ..... 72/307, 306, 318, 386, 72/384, 214, 447, 453.01, 453.02, 215, 454, 7, 294

[56] References Cited

U.S. PATENT DOCUMENTS

| | | | |
|---|---|---|---|
| 603,096 | 4/1898 | Worth | 72/215 |
| 644,249 | 2/1900 | Keyes | 72/215 |
| 747,272 | 12/1903 | Tierney | 721/447 |
| 2,986,194 | 5/1961 | DeMarco | 72/215 |
| 3,420,279 | 1/1969 | Tuit | 72/306 |
| 4,061,005 | 12/1977 | Kawanami et al. | 72/307 |
| 4,367,641 | 1/1983 | Mizutani | 72/307 |
| 4,655,069 | 4/1987 | Remy et al. | 72/306 |

FOREIGN PATENT DOCUMENTS

| | | |
|---|---|---|
| 3028834 | 7/1980 | Fed. Rep. of Germany . |
| 3523828 | 7/1985 | Fed. Rep. of Germany . |

*Primary Examiner*—Daniel C. Crane

*Attorney, Agent, or Firm*—Nilles & Nilles, S.C.

[57] ABSTRACT

In an apparatus for bending an elongated material such as a wire, strip or section bar material, at least one bending finger is mounted for displacement perpendicularly between an extended and a retracted position relative to a working plane in a cross-carriage mechanism disposed parallel to the working plane (AE) and operable for displacement in two rectilinear intersecting directions (x, y) parallel to the working plane (AE), said cross-carriage mechanism (K) comprising an outer carriage (19) mounted for displacement in the X direction, and an inner carriage (15) mounted in said outer carriage (19) for displacement in the Y direction, each carriage being provided with a separate bending actuator mechanism (18, 24). The bending actuator mechanisms (18, 24) are adapted to be numerically controlled by a control device (C) of the bending apparatus (1) either separately or in unison. In addition to rectilinear and circular-arcuate displacements in the working plane (AE), the cross-carriage mechanism (K) is capable of producing any type of movements in the working plane (AE) as required by any given bending operation.

17 Claims, 2 Drawing Sheets

BENDING APPARATUS

BACKGROUND OF THE INVENTION

1. Field of the Invention The invention relates to an apparatus for bending an elongated material such as wire, strip or section bar material.

2. Description of the Related Art

In a bending apparatus known from DE Patent No. 3,523,828, each bending finger with its carrier is mounted in a tool carriage for displacement parallel to the working plane and perpendicular to the material feed direction. During the bending operation the bending finger is only displaceable in this fixed direction. In the same manner bending mandrels acting as counter-stop elements are mounted in respective tool carriages. The tool carriage is mounted on prismatic guide rails for displacement parallel to the working plane and parallel to the material feed direction. This apparatus is only capable of performing simple bending operations about limited bending angles. The bending operation results in sliding displacements of the material to be bent and the only linearly displaceable bending finger relative to one another, giving rise to excessive friction forces. Since in the course of the bending operation the bending finger does no longer act on the material perpendicular to its longitudinal direction, but rather at an increasingly acute angle, deviations from the predetermined bending radius cannot be excluded as the bending operation proceeds.

Known from DE-OS 30 28 834 is an apparatus for punching and bending workpieces, in which a bending station includes two tool carriages for the linear displacement of respective bending fingers back and forth in a direction perpendicular to the material feed direction. Although the end points of the bending finger displacement can be adjusted during the bending operation within certain tolerance limits, an adjustment of the tool carriages, which are guided in a circular groove extending parallel to the work plane, is only possible after the apparatus has been stopped. The bending operation itself is hampered by the same shortcomings as in the apparatus referred to in the first place.

SUMMARY OF THE INVENTION

It is an object of the present invention to provide an apparatus of the type defined above, which permits complicated bending operations with varying bending radii to be carried out accurately and at a high operating speed.

This object is attained according to the invention by a bending finger, mounted on a carrier, which is extendable and retractable perpendicularly into and out of a working plane. The carrier 14 carrying the bending finger 13 is mounted on a carriage means permitting it to be displaced during the bending operation in a plane extending parallel to the working plane AE, along a path which is the result of the simultaneous movement of two intersecting drive paths.

The disclosed construction permits the bending finger to be displaced along practically any conceivable path during the bending operation, so that its direction of displacement can be optimized with respect to the material to be bent. The simultaneous displacement, for instance, of the bending finger along both work paths of the carriage means permits the bending finger at all times to act perpendicularly on the material to be bent. For varying the bending radius during the bending operation, the bending finger may further be displaced along a path causing it to gradually approach the bending mandrel or to move away therefrom. In addition it is possible to materialize practically any desired bending angle, because the bending finger can move around the bending mandrel. The carriage means offers the essential advantage that the bending finger is capable of being displaced along varying paths during successive bending steps and also during a single bending step without having to stop the apparatus, because it is not bound to a rigid displacement program thanks to its displaceable mounting in the carriage means. The actual movements of the bending finger results from the simultaneously occurring displacements along the two work paths.

The carriage means is a cross carriage mechanism K defining two rectilinear work paths (x, y) and intersecting one another in two preferably mutually perpendicular displacement directions, which offers the advantage of simply controllable linear displacements in the two working directions. The actual movement of the bending finger can be readily predetermined by means of a simple X-Y coordinate system. It would also be possible, however, to combine a rectilinear work path in the carriage mechanism with a curved, for instance circular, work path, i.e. to mount a rotatable carriage in a linearly displaceable carriage or vice versa.

A separate linear bending drive mechanism is provided for each displacement direction (x, y). During the bending operation the bending drive mechanisms 18, 24 are selectively operable separately or in unison, which permits the actual movements of the bending finger to be accurately and delicately controlled by means of the two bending drive mechanisms each for a respective work path.

The control device C of the bending apparatus comprises a preferably microprocessor-controlled numeric control unit N at least for the two bending drive mechanisms 18, 24. Such a control device is conducive to ensure accurate, smooth and steady movements of the bending finger, because the microprocessor-controlled numeric control unit is capable of simultaneously controlling the individual displacements of the two carriages of the carriage mechanism in the X and Y directions with exceptional accuracy.

The cross carriage mechanism K is displaceable perpendicularly to the working plane AE for the displacement of the bending finger 13 perpendicular to the working plane AE. Alternatively, the bending finger 13 including the carrier 14 is mounted in the cross carriage mechanism K for displacement perpendicular to the working plane AE and connected to a displacement drive mechanism 46 mounted on the cross carriage mechanism. Accordingly, the displacements of the bending finger perpendicular to the working plane can either be accomplished by corresponding displacements of the carriage mechanism itself, or by displacement of the carrier in the carriage mechanism, when it is required to move the bending finger out of the path of the material prior to and after a bending operation and/or for advancing the material to be bent.

The carriage means comprises an outer carriage 19 mounted for displacement in the X direction in a stationary carriage guide below the working plane, and an inner carriage 15 mounted for displacement in the Y direction in the outer carriage. The bending drive mechanism 24 for the outer carriage 19 is mounted in a stationary carriage guide portion 25, and the bending drive mechanism 18 for the inner carriage 15 is mounted in the outer carriage. Such a construction is structurally simple, highly resistant under load and smoothly operable. Due to this construction, the reaction forces acting on the bending finger during the bending operation are uniformly and smoothly distributed on the two carriages and the stationary carriage guide through a large surface contact.

Although the directions of displacement of the two carriages in the cross-carriage mechanism could also be directed obliquely with respect to one another for the performance of specific bending operations, the X axis and Y axis in practice preferably enclose an angle of 90°, with the main direction coniciding with the feed direction of the material. This is accomplished by having the outer carriage 19 mounted for displacement in the X direction parallel to the material feed direction, and the inner carriage 15 mounted for displacement in the Y direction perpendicular thereto.

The outer carriage 19 further comprises an open rectangular frame having lateral frame members 20 and upper and lower frame members 21, **21*a*, 21*b*. The inner carriage 15 further comprises an open rectangular frame having extended frame side members and is mounted between the lateral frame members 20 of the outer carriage 19 for displacement therealong. The carrier 14 carrying the bending finger 13 is disposed, preferably replaceably, in the frame opening of the inner carriage 15**. This arrangement provides a mechanically stable and space-saving construction of the cross-carriage mechanism. The manufacture of the two carriages is simple. They may be conceived as a bolted or welded construction.

The outer and inner carriages are each provided with an inner support roller 35, 38 mounted on a respective frame member extension **21*a*, 21*b* parallel to the working plane AE, and adjacent thereto two outer guide rollers 36, 39 mounted at an offset angle of 90°. The support rollers 35, 38 are supported on a respective first guide path 29, 32 perpendicular to the working plane AE, and the two guide rollers 36, 39 are supported on respective opposite second guide paths 30, 31 forming lateral boundaries of the first guide path 29, 32 and extending parallel to the working plane AE so that respective gaps (a) are defined between the frame members 21 and the guide paths 29, 32**. Such a construction offers the advantage that the movable components are smoothly guided relative to one another with reduced friction therebetween, resulting in the required accurate and smooth displacements of the bending finger during the bending operation. The rollers ensure a play-free and smooth guidance by eliminating direct metallic contacts and the transmission of vibrations between the inner carriage, the outer carriage and the carriage guide. The lateral rollers are effective to transmit forces created in directions obliquely to the working plane by the bending finger projecting freely above the working plane.

The guide paths 29, 30 for the outer carriage 19 are provided on guide members 28, 33 mounted in a stationary support frame 2 behind the working plane AE, and the guide paths 31, 32 for the inner carriage 15 are disposed on the longitudinal frame members 20 of the outer carriage 19. Accordingly, the frame members and guide members are charged with double functions inasmuch as they are not only employed for the absorption of forces, but also for the guidance of displacements.

The carrier 14 is a square piston displaceably mounted in a socket 49 in the inner carriage 15, and the displacement mechanism 46 comprises an actuator cylinder mounted on the side of the inner carriage 15 facing away from the working plane and having its piston rod 45 releasably coupled to the carrier 14, which ensures stable mounting of the bending finger without impairing its displaceability at any time.

The two bending drive mechanisms 18, 24 comprise respective hydraulic or pneumatic actuating cylinders having their piston rods 17, 23 articulated 16, 22, preferably in a releasable manner, to respective frame members 21 of the outer and inner carriages 19, 25, respectively. Bending drive mechanisms employing hydraulic or pneumatic actuator cylinders are capable of ensuring accurately controllable displacements of the individual components in extremely small steps, and additionally of transmitting sufficiently strong forces. It would also be conceivable, however, to employ electric motors (step motors), gear transmissions or the like for the displacement of the carriages.

The outer carriage 19 is shielded from the working plane AE by a cover 50 secured to the support frame 2 and provided with a window corresponding to the displacement range of the inner carriage 15. The window is closed by a cover plate 51 secured to the inner carriage 15 for displacement in unison therewith and provided with a passage for the bending finger 13. A cover of this type offers the important advantage that the cover members do not hamper the smooth movements of the carriage mechanism while preventing the infiltration of dirt or coolant or the escape of lubricant, respectively.

The carriage means is provided with position detector means 47, 48 connected to the control device C for detecting the positions of at least the outer and inner carriages 19, 15, which offers the important advantage that the control device is continuously informed of the actual position of the bending finger in the carriage mechanism and thus enabled to accurately control the displacements required for the bending operation.

At least one bending mandrel is associated to the bending finger at the bending station, characterized in that a mounting arm 40 secured to the support frame 2 and extending over the working plane AE carries a rotatably mounted revolver head 41 in which a plurality of bending mandrels 44 is extendably retained by respective insert members 43 for selective rotation to a bending position. The employ of the revolver head permitting any one of several bending mandrels to be selectively aligned in the bending position for cooperation with the bending finger takes account of the fact that thanks to its being mounted in the carriage mechanism, the bending finger is capable of rapidly executing universal and varying movements which may even vary from one bending step to the next, in which case it may be required to employ rapidly interchangeable bending mandrels. The mounting of the bending mandrels in the revolver head disposed on the side of the working plane opposite the carriage mechanism offers the further advantage that the movements of the individual components of the carriage mechanism are not hampered.

A cutting device 42 preferably designed as a shaping punch F is disposed downstream of the bending finger 13 in the material feed direction on the side of the working plane opposite the carriage means. The cutting device permits the finished bent workpieces to be cut off immediately downstream of the bending location, the construction of the cutting device as a shaping punch additionally permitting the leading or trailing end of the workpieces to be cut off at any practically conceivable shape. The numeric control feature employed for the displacements of the bending finger may of course also be used for the advance of the material, so that the finished workpieces can be cut off by the cutting device in an accurately controlled manner, even although the cutting device is disposed immediately downstream of the operating station of the bending finger and the bending mandrel.

The microprocessor-assisted numeric control unit is suitably devised for controlling all of the movable components of the apparatus, so that widely varying bending steps with different bending radii and bending angles as well as the cut-off operation are smoothly performed in a substantially automatic process without undue delays, because the control unit is at all times informed with the predetermined accuracy of the actual position of the material to be bent and of the process step to be carried out at that specific instant, thus enabling it to control the operation of the respective mechanism. This results in the further advantage that the longitudinal spacing between the bending station, the cutting device and an optionally provided upstream punching station are of no importance, because the numeric control unit is readily capable of controlling the performance of different steps simultaneously or rapidly progressive intervals.

An embodiment of the subject matter of the invention shall now be described by way of example with reference to the accompanying drawings, wherein.

Figure 1:
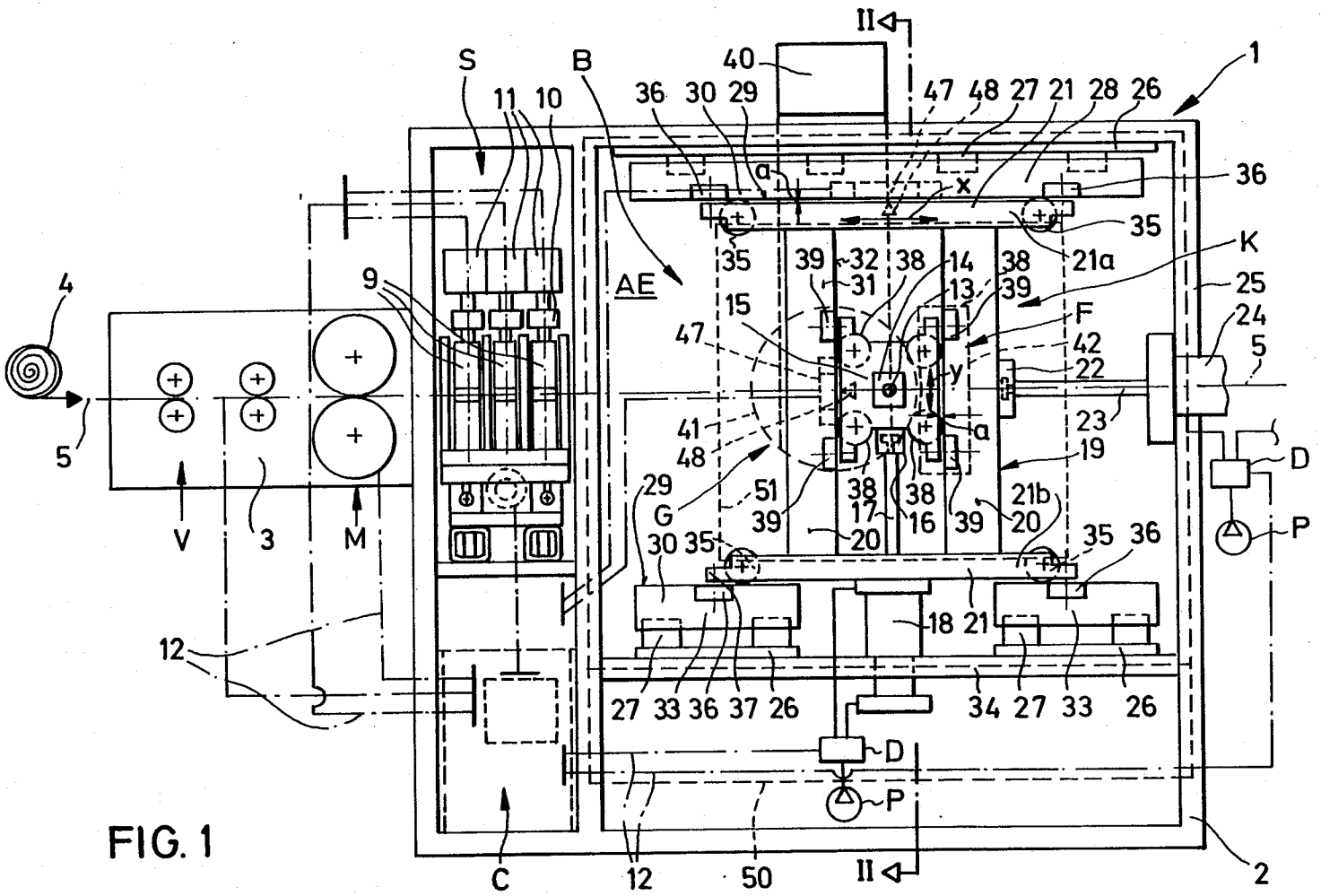
FIG. 1 shows a diagrammatic front view of a punching and bending apparatus.

An apparatus 1 for bending an elongate material such as wire, strip or section bar material 5 has a three-dimensional frame 2 composed of vertical and horizontal frame members and having a cantilevered extension 3 secured thereto at one end. Disposed upstream of extension 3 in the feeding direction of material 5 as indicated by an arrow is a material supply 4, for instance a supply reel from which material 5 is unwound. Provided in succession in the feeding direction of material 5 is a feeding mechanism V, optionally with an alignment function, disposed on extension 3, a punching station S disposed in frame 2, and beyond that a bending station B. Disposed at bending station B to the rear of a working plane AE passing through material 5 is a cross-carriage mechanism K, and in front of working plane AE, a counterstop mechanism G succeeded by a cut-off mechanism F. Also disposed in frame 2 is a control device C including a numeric control unit N operatively connected to the various movable components of apparatus 1.

Disposed on a cross member 6 of frame 2 at punching station S are three punching units 9 mounted on guides 7 extending perpendicular to the plane..of the drawing and individually connected to separate actuators 11 by respective couplings 10. A further actuator 8 is provided for the displacement of punching units 9 along guides 7 in unison with their actuators 11. In the embodiment shown, the three punching units 9 are displaceable in unison. It is of course also possible, however, to mount each punching unit so that it is separately displaceable.

The control connections connecting the various actuators or detecting devices to control device C are generally designated by reference numeral 12. The numeric control unit N included in control device C is suitably equipped with microprocessors.

Figure 2:
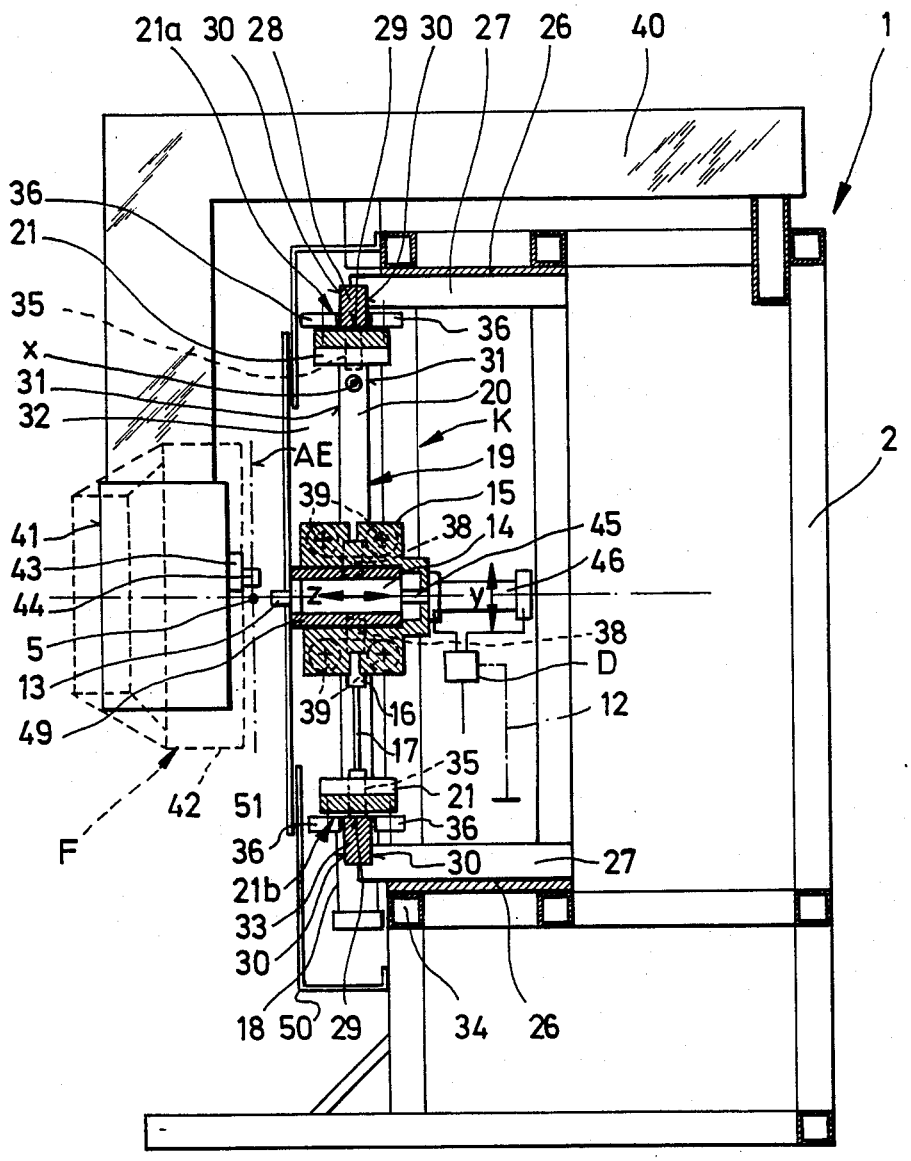
FIG. 2 shows a sectional view of the apparatus taken in the plane II—II of FIG. 1.

Disposed in cross-carriage mechanism K as an active bending tool is a bending finger 13 mounted for displacement in three mutually perpendicular directions x, y and z. Bending finger 13 is secured to a carrier 14 having the shape of a square piston and mounted for displacement in the direction z in an inner carriage 15 of cross-carriage mechanism K (FIG. 2). Secured to the bottom side of inner carriage 15 is a coupling member 16 hingedly connected to a piston rod 17 of a hydraulic of pneumatic cylinder 18 acting as a bending actuator. Bending actuator 18 is operable for displacement in the y direction and connected to a pressure control unit D via supply pipes, pressure control unit D itself being supplied from a pressure source P and likewise connected to control device C. Inner carriage 15 is mounted for displacement in the y direction in an outer carriage 19 formed as an open frame having lateral frame members 20 and upper and lower frame members 21. Bending actuator 18 is secured to lower frame member 21.

Upper and lower frame members 21 are provided with extensions **21*a*, 21*b* extending beyond lateral frame members 20, the overall length of lower frame member 21 being greater than that of upper frame member 21. Secured to the righthand lateral frame member 20 in FIG. 1 is a coupling member 22 having a piston rod 23 of another bending actuator 24 hinged thereto. Bending actuator 24 is a hydraulic or pneumatic cylinder connected to pressure source P via rpessure control unit D itself connected to control device C. Bending actuator 24 is mounted on a frame member 25 of frame 2 and operable for displacement in the x direction. Outer carriage 19 is mounted for displacement in the x direction in a stationary guide comprising upper and lower mounting plates 26 secured to cross members 34 of base frame 2 and provided with mounting lugs 27 for respective elongate guide members 28 (above) and 33 (below). Lower guide members 33 are separated from one another by an open space for permitting the displacement of bending actuator 18 in the x direction. Bending actuator 18 may also be mounted, however, to the rear of the plane defined by guide members 33, in which case a continuous lower guide member may be used similar to upper guide member 28**.

Upper guide member 28 is provided with a guide path 29 directed perpendicular to the working plane and parallel to the feeding direction of material 5, and two guide paths 30 on opposite sides thereof extending parallel to the working plane. Lateral frame members 20 of outer carriage 19 are provided with guide paths 32 directed perpendicular to the working plane AE and to the feeding direction of material 5, and guide paths 31 on opposite sides thereof extending parallel to the working plane.

Inner carriage 15 is displaceable on guide paths 31 and 32; outer carriage 19 is displaceable on guide paths 29 and 30. The smooth displacement of the two carriages 15 and 19 is ensured by respective support and guide rollers 35, 36, 38 and 39. Mounted in extensions **21*a* and 21*b* of upper and lower frame members 21 of outer carriage 19 are respective support rollers 35 rotatable in a plane parallel to the working plane and supported on guide paths 29 in such a manner that upper and lower frame members 21 face the respective guide paths 29 with a space a therebetween. Also mounted in extensions 21***a*, 21*b* at locations adjacent each support roller 35 for rotation in planes perpendicular to working plane AE are two guide rollers 36 engaging guide paths 30 for supporting outer carriage 19 in directions perpendicular to the working plane.

In the same manner inner carriage 15 is mounted for displacement in outer carriage 19. Mounted at the four corners of inner carriage 15 for rotation in a plane parallel to working plane AE are respective support rollers 38 supported on guide paths 32. Mounted adjacent thereto for rotation in planes perpendicular to the working plane are respective pairs of guide rollers 39 engaging guide paths 31 for supporting inner carriage 15 in directions perpendicular to the working plane. Support rollers 38 are mounted so as to maintain a gap a between inner carriage 15 and guide paths 32 on both sides.

Secured to the top of mounting frame 2 is a cantilevered mounting arm 40 extending downwards in front of the working plane AE to a location opposite bending station B. Rotatably mounted on mounting arm 40 is a revolver head 41 carrying a plurality of inserts 43 each with a bending mandrel 44 or pair of bending mandrels mounted therein in such a manner that any bending mandrel 44 can be aligned in a bending position and extended towards the working plane AE.

Mounting arm 40 may also be used as a carrier base for cut-off device F, which may advantageously be designed as a shaping punch 42, so that the leading and trailing ends of individual workpieces cut from material 5 can be shaped to a desired configuration. The drive mechanisms for revolver head 41 and cut-off device F are advantageously also connected to control device C.

For the displacement of bending finger 13 in the z direction between extended and retracted positions thereof relative to the working plane AE, carrier 14 is connected to a piston rod 45 of an actuator 46, preferably a pneumatic or hydraulic cylinder secured to inner carriage 15 or to a socket 49 in which carrier 14 is guided. Supply pipes of actuator 46 are connected to a not shown pressure source through pressure control unit D, the latter being connected to control device C by a signaltransmitting connection.

Respective position detectors 47, 48 may advantageously be provided between guide member 28 and upper frame member 21, and between inner carriage 15 and lateral frame member 20 of outer carriage 19, and connected to control device C. In this manner control device C is at all times informed of the actual position of bending finger 13. Similar position detectors may also be associated to the other movable components of bending apparatus 1 and likewise connected to control device C.

Mounting frame 2 is further advantageously provided with a cover 50 for protecting cross-carriage mechanism K. Cover 50 is suitably made of sheet metal and formed with a central opening which is closed by a cover plate 51 secured to inner carriage 15. Cover plate 51 has a passage for bending finger 13 and follows the displacements of the inner carriage.

The apparatus may further be provided with guide means or hold-down means for the material to be bent located adjacent the bending station.

The described apparatus 1 operates as follows:

Feeding device V operates to advance material 5 through measuring device M and to simultaneously align or straighten it. Any cutouts, embossed patterns or characters or the like possibly required at determined locations of the finished workpieces may be formed at the punching station S. To this purpose control device C selects the specific punching unit 9 to be used and controls the displacement of punching units 9 on guides 7 until the selected tool is properly aligned with respect to the centerline of the material, whereupon the selected punching unit is actuated when the respective location on the material has reached the correct position at the punching station. Successive punching operations can be performed in this manner. As soon as the material has reached the bending station B, a selected bending mandrel 44 is rotated to the bending position and extended into the bending plane AE. Bending finger 13 is extended into the working plane AE and is then displaced along a predetermined path relative to bending mandrel 44 by the operation of cross-carriage mechanism K. Control device C acts to start the displacement of bending finger 13 only, however, after a predetermined longitudinal section of material 5 has been aligned at the bending position. As soon as a bending step or several successive bending steps has, or have, been carried out in this manner, the material 5 is further advanced and finally cut off as soon as a predetermined longitudinal location of the material has reached the cut-off device F. During the bending operation the trailing portions of the material can already be subjected to further punching operations. The individual processing steps will normally be carried out in succession, the numeric control function permitting these operations to be carried out at a fast rate and in a fully automatic manner. When bending finger 13 is to be replaced, it can be dismounted together with carrier 14 or separately therefrom in the direction towards working plane AE. It is also conceivable to provide apparatus 1 with a succession of bending stations B each with a bending finger carried by a cross-carriage mechanism. As another possibility, the apparatus might be provided with further bending stations with conventionally operable bending fingers in addition to the described bending station incorporating a cross-carriage mechanism. It would further be conceivable to rotate the mounting position of the cross-carriage mechanism K about an angle of 90°, so that the inner carriage would be displaceable in the feeding direction of the material, and the outer carriage perpendicular thereto. The support and guide rollers 35, 36, 38 and 39 may also be replaced by sliding guide members or linear roller bearings for ensuring smooth displacement of the two carriages 15 and 19. The various movable components of the apparatus may be collectively connected to a central lubrication system of the apparatus.

I claim:

1. Apparatus for bending an elongated material such as wire, strip or section bar, comprising:

a support frame (2);

means mounted on said support frame (2) for feeding material along a feed direction into a working plane (AE) of a bending station;

carriage means movably mounted to said support frame (2) displaceable during a bending operation in a plane parallel to said working plane (AE) along a path defined by the simultaneous movement of two intersecting work paths (x, y), the direction of at least one work path directed across the material feed direction;

a bending drive mechanism for displacing said carriage means;

a control device (C) connected to said bending drive mechanism;

a carrier (14) mounted on said carriage means;

a bending finger (13) for bending said wire, strip or section bar mounted on said carrier (14) and perpendicularly extendable and retractable into and out of said working plane (AE), respectively, and a bending mandrel (44) for cooperation with said bending finger (13).

2. Apparatus according to claim 1 wherein said carriage means is a cross carriage mechanism (K) defining two rectilinear work paths (x, y) intersecting one another in two mutually perpendicular displacement directions.

3. Apparatus according to claim 1 wherein each displacement direction (x, y) is provided with a separate linear bending actuator (18, 24) and that during the bending operation said bending actuators (18, 24) are selectively operable separately or in unison.

4. Apparatus according to claim 3 wherein said control device (C) comprises a microprocessor-controlled numeric control unit (N) at least for said separate linear bending actuators (18, 24).

5. Apparatus according to claim 1 wherein said carriage means is displaceable perpendicularly to said working plane (AE) for the displacement of said bending finger (13) perpendicular to said working plane (AE).

6. Apparatus according to claim 1 wherein said bending finger (13) including said carrier (14) is mounted in said carriage means for displacement perpendicular to said working plane (AE) and connected to a displacement drive mechanism (46) mounted on said carriage means.

7. Apparatus according to claim 1 wherein said carriage means comprises an outer carriage (19) mounted for displacement in the X direction in a stationary carriage guide below said working plane, and an inner carriage (15) mounted for displacement in the Y direction in said outer carriage (19), and that said bending drive mechanism comprises a first bending actuator (24) mounted on said stationary carriage guide for displacement of said outer carriage (19), and a second bending actuator (18) mounted on said outer carriage (19) for displacement of said inner carriage (15).

8. Apparatus according to claim 7 wherein said outer carriage (19) is mounted for displacement in the X direction parallel to the material feed direction, and said inner carriage (15) is mounted for displacement in the Y direction perpendicular thereto.

9. Apparatus according to claim 8 wherein said outer carriage (19) comprises an open rectangular frame having lateral frame members (20) and extended upper and lower frame members (21, 21*a*, 21*b*), said inner carriage (15) comprises an open rectangular frame having extended frame side members and is mounted between said lateral frame members (20) of said outer carriage (19) for displacement therealong, and said carrier (14) carrying said bending finger (13) is disposed, replaceably, in the open rectangular frame of said inner carriage (15).

10. Apparatus according to claim 9 wherein said outer and inner carriages are each provided with an inner support roller (35, 38) mounted on a respective frame member extension (21*a*,21*b*) parallel to said working plane (AE), and adjacent thereto two outer guide rollers (36, 39) mounted at an offset angle of 90°, said support rollers (35,38) are supported on a respective first guide path (29, 32) perpendicular to said working plane (AE), and said two guide rollers (36, 39) are supported on respective opposite second guide paths (30,31) forming lateral boundaries of said first guide path (29,32) and extending parallel to said working plane (AE), so that respective gaps (a) are defined between said frame members (21) and said guide paths (29,32).

11. Apparatus according to claim 10, wherein said guide paths (29,30) for said outer carriage (19) are provided on guide members (28,33) mounted in the support frame (2) behind said working plane (AE), and said guide paths (31,32) for said inner carriage (15) are disposed on the lateral frame members (20) of said outer carriage (19).

12. Apparatus according to claim 6 wherein said carrier (14) is a square piston displaceably mounted in a socket (49) in said carriage means, and that said displacement mechanism (46) comprises an actuator cylinder mounted on a side of said carriage means facing away from said working plane and having its piston rod (45) releasably coupled to said carrier (14).

13. Apparatus according to claim 3 wherein said separate linear bending actuators (18, 24) comprise respective hydraulic or pneumatic actuating cylinders having their piston rods (17, 23) articulated (at 16, 22) in a releasable manner to said carriage means.

14. Apparatus according to claim 7 wherein said outer carriage (19) is shielded from said working plane (AE) by a cover (50) secured to said support frame (2) and provided with a window corresponding to the displacement range of said inner carriage (15), and that said window is closed by cover plate (51) secured to said inner carriage (15) for displacement in unison therewith and provided with a passage for said bending finger (13).

15. Apparatus according to claim 7 wherein said carriage means (K) is provided with position detector means (47,48) connected to said control device (C) for detecting the positions of at least said outer and inner carriages (19,15).

16. Apparatus according to claim 1 further comprising of at least one bending mandrel associated to said bending finger at said bending station, a mounting arm (40) secured to said support frame (2) and extending over said working plane (AE), a rotatably mounted revolver head (41) on said mounting arm (40) in which a plurality of bending mandrels (44) is extendably retained by respective insert members (43) for selective rotation to a bending position.

17. Apparatus according to claim 1 further comprising a cutting device (42) designed as a shaping punch (F) disposed downstream of said bending finger (13) in the material feed direction on the side of said working plane opposite said carriage means.

* * * * *